United States Patent [19]

Hynst et al.

[11] 4,387,646

[45] Jun. 14, 1983

[54] DEVICE FOR INCREASING THE INK SUPPLY TO THE INKING UNIT OF A PRINTING MACHINE

[75] Inventors: Karel Hynšt, Adamov; Mojmír Trávníček, Blansko, both of Czechoslovakia

[73] Assignee: ZVS-Adamovske strojirny, koncernovy podnik, Prague, Czechoslovakia

[21] Appl. No.: 287,875

[22] Filed: Jul. 29, 1981

[30] Foreign Application Priority Data

Jul. 31, 1980 [CS] Czechoslovakia ..... 5351-80

[51] Int. Cl.[3] ..... B41F 31/14; B41F 31/12; B41L 27/16

[52] U.S. Cl. ..... 101/350; 101/DIG. 6

[58] Field of Search ..... 101/349, 348, 350, 363, 101/DIG. 6, 148, 206, 207, 208–210

[56] References Cited

U.S. PATENT DOCUMENTS

| | | | |
|---|---|---|---|
| 956,316 | 4/1910 | Droitcour | 101/363 |
| 992,475 | 5/1911 | Barber | 101/363 |
| 2,083,542 | 6/1937 | Barber | 101/350 |
| 2,177,261 | 10/1939 | Lembcke | 101/349 |
| 2,950,677 | 8/1960 | Staley | 101/350 |
| 4,050,383 | 9/1977 | Hynšt | 101/DIG. 6 |

*Primary Examiner*—J. Reed Fisher

*Attorney, Agent, or Firm*—Burgess, Ryan and Wayne

[57] ABSTRACT

The invention is a device for increasing the ink supply to the inking unit of a printing machine. The device provides a means for changing an intermittently rotating doctor roller to a continuously rotating doctor roller without changing the adjustments required to operate as an intermittently rotating doctor roller thereby increasing the supply of ink to the inking unit.

6 Claims, 3 Drawing Figures

DEVICE FOR INCREASING THE INK SUPPLY TO THE INKING UNIT OF A PRINTING MACHINE

The invention is an improved device for supplying ink to the inking unit of a printing machine and particularly an offset printing machine. The device provides a means for increasing the ink transferred to the inking system without necessity for changing the adjustment of the inking system.

BACKGROUND OF THE INVENTION

The inking system of a printing machine generally comprises a rotating doctor roller which picks up ink on its surface from a supply ink fountain. A uniform ink film is formed on the roller by means of an adjustable blade. The ink is transferred from the doctor roller to the ink feed roller and transferred into the inking roller system.

In the devices presently used, the doctor roller rotates continuously or intermittently. The amount of ink transferred to the ink feed roller from the continuously rotating doctor roller depends on the length of mutual rolling path of both rollers. In the devices having an intermittently rotating doctor roller, the amount of ink transferred to the ink feed roller depends on the angle of rotation and contact of the doctor roller which is generally adjustable.

In the devices which are provided with a continuously rotating doctor roller, the amount of ink supplied to the inking system is regulated by the length of rolling contact of the doctor roller with the ink feed roller which is controlled by a regulation element. The amount of ink supplied to the inking system cannot be changed without readjustment of the regulation element.

BRIEF DESCRIPTION OF THE INVENTION

The disadvantages of known devices are overcome by the device of the present invention which comprises a sprocket rotatingly mounted with clearance on the doctor roller shaft. The sprocket is provided with a sprocket hub, the front wall of which is provided with at least one recess which engages at least one carrying pin fixed on a knob hub. The sprocket is coupled fixedly with a pawl disk, the circumferential curve of which is formed by two different radii and against which bears a follower roller of a rocking bent lever which rocks on a lever shaft which is mounted with a clearance on the side wall of the printing machine.

A clamping lever is mounted on the lever shaft in addition to the rocking bent lever. The clamping lever is provided with a cut-out in which is located a pull rod fixed with its one end on the rocking bent lever arm. The clamping lever arm bears with a set over part against the rocking bent lever arm. The pull rod is fitted with a spring which bears with its one end against the clamping lever arm and with its opposite end against a regulation nut threadedly mounted at the end of the pull rod. An ink transfer roller is mounted on arms fixedly mounted on the lever shaft.

Near the end of the doctor roller shaft is mounted a pin. At the ends of said pin are mounted guide rollers which engage slots formed in a knob hub. A spring is mounted in a cavity in the knob hub. The spring bears with its one end against the end of the doctor roller shaft and with its opposite end against a spring bearing structure which can be the bottom of the cavity formed in the knob hub. The spring mounted in the knob hub cavity prevents engagement of the pins with the recesses unless pressure is applied to the knob. The knob can be rotatingly connected to said knob hub (not shown).

An advantage of the present invention is that by engaging at least one carrying pin with at least one recess in the sprocket hub by pressing on the knob, the doctor roller is caused to rotate continuously. Since the amount of ink being supplied to the inking roller system depends on the doctor roller rotation, the ink supply to the inking roller system is increased to its maximum.

After the carrying pins are disengaged from the sprocket hub recess, the originally adjusted rate of ink supply is renewed automatically.

DETAILED DESCRIPTION OF THE INVENTION

Figure 1:
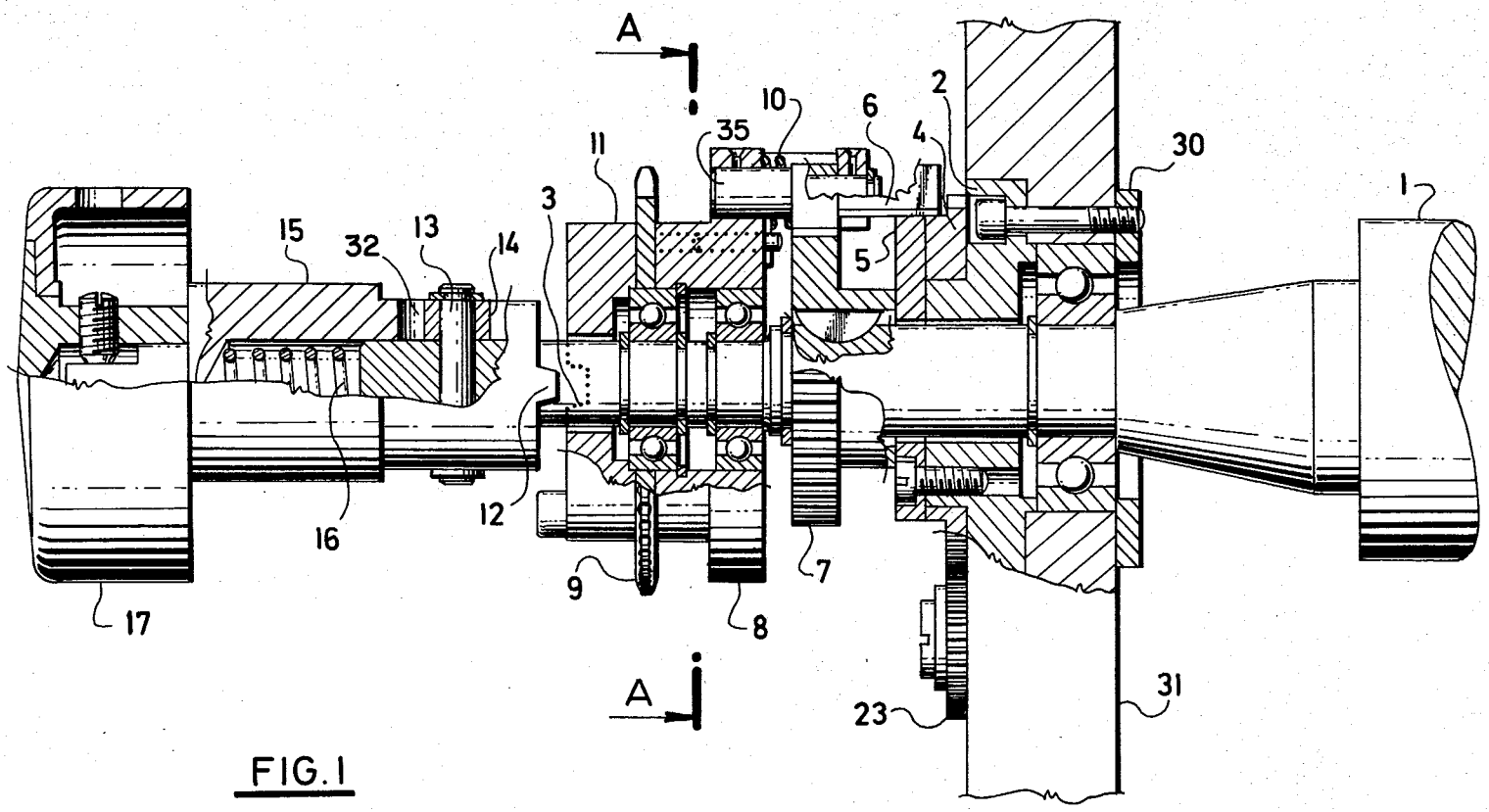
FIG. 1 is a side view in section of the doctor roller and gearing.
Figure 2:
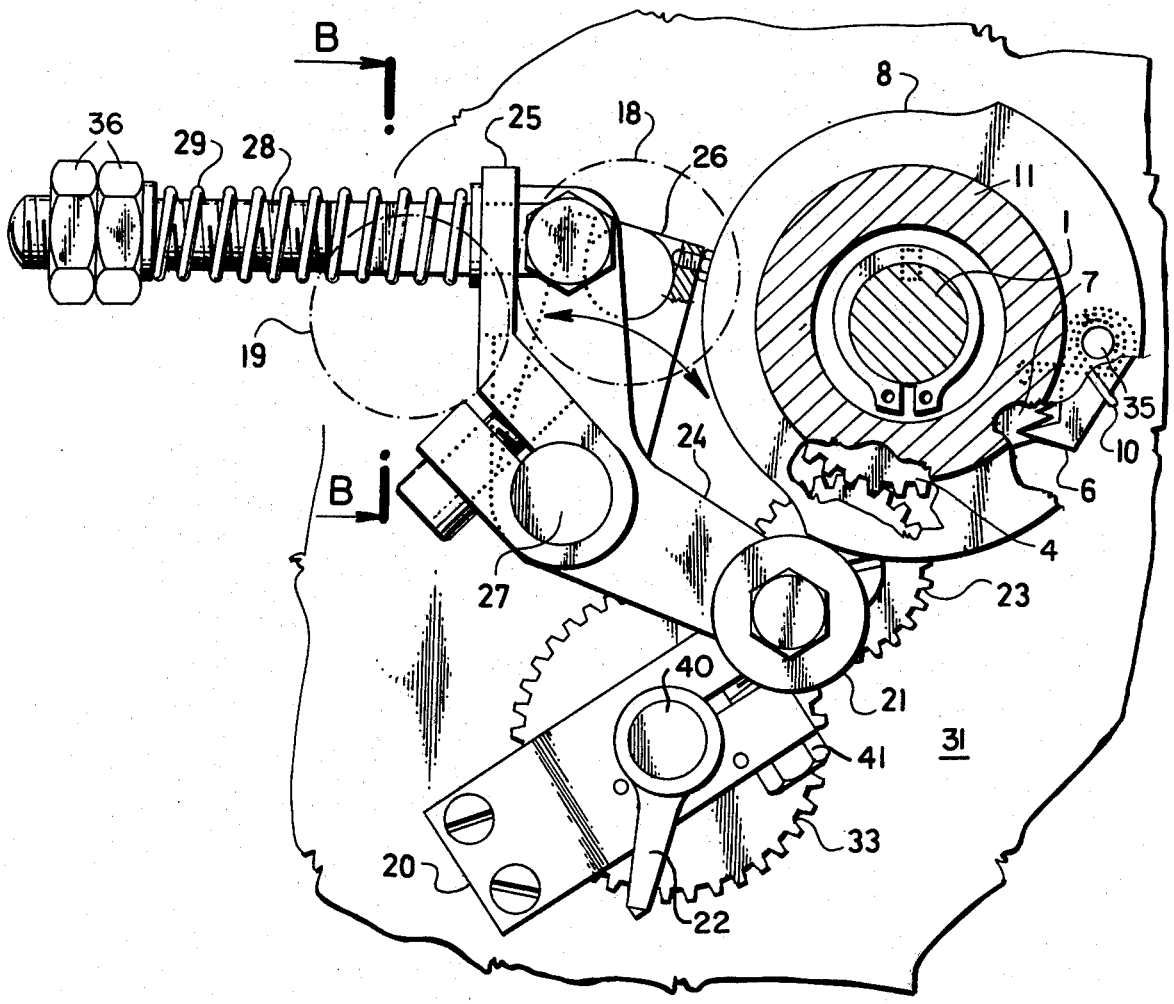
FIG. 2 is a view of the doctor roller and associated apparatus along plane A—A of FIG. 1.
Figure 3:
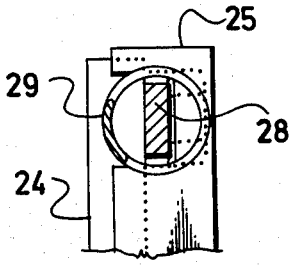
FIG. 3 is a view of the pull rod from plane B—B of FIG. 2.

A preferred embodiment of the invention is depicted schematically in the attached drawings where FIG. 1 is a side view of the doctor roller in section. In FIG. 2, the device is illustrated including the inking rollers in a broken-out section passing through the plane A—A of FIG. 1. FIG. 3 is a broken-out section passing through the plane B—B of FIG. 2.

The device according to the invention comprises a doctor roller 1 which is rotatingly mounted on the side wall 31 of the printing machine. Axial movement of the doctor roller is prevented by insert 2. Insert 2 is fixed by means of the washer 30 and screws on the side wall 31 of the printing machine. On the stepped part of insert 2, the adjustable cam 4 is fitted with a clearance. Adjustable cam 4 is provided with teeth which engage the teeth of intermediate gear 23 which is mounted with clearance on the side wall 31 of the printing machine. On the insert 2, cam 5 is fixedly mounted by means of screws. On the shaft of the doctor roller 1 is fixedly mounted ratchet wheel 7 which engages pawl 6 provided with a pin 35 which is fitted with clearance in the pawl disk 8. The pawl 6 is forced by means of torsion spring 10 into contact with cam 5 or with the adjustable cam 4. The sprocket 9 is rotatably mounted with clearance on the shaft of doctor roller 1. The sprocket 9 is fixedly connected with sprocket hub 11. The sprocket 9 is fixedly coupled with pawl disk 8 which is rotatably mounted with clearance on the shaft of doctor roller 1. The circumference of pawl disk 8 is formed by two different radii as shown in FIG. 2. At the end of the shaft of doctor roller 1 is slidably mounted knob 17 and knob hub 15. Tapered recesses 3 are formed in the face of sprocket hub 11 of sprocket 9 to engage tapered carrying pins 12 mounted on knob hub 15 of knob 17.

A pin 13 is mounted near the end of the shaft of doctor roller 1. At the ends of pin 13 are mounted with clearance guide rollers 14 which engage the adjacent longitudinal walls of axially oriented slots 32 in the knob hub 15 of knob 17. A return spring 16 is mounted in the cavity of knob hub 15 and bears with its one end against the end of the shaft of doctor roller 1 and with its opposite end against the cavity bottom of knob hub 15 of knob 17, to bias the pins 12 away from the recesses 3.

Between the doctor roller 1 and the distributing roller 19 (FIG. 2) is located ink feed roller 18 mounted in arms 26 fixedly mounted on shaft 27 which is mounted with clearance on the side walls of the printing machine. The rocking bent lever 24 is rotatably mounted on shaft 27. At one end of rocking bent lever 24 is fixed pull rod 28 which passes through a cut-out clamping lever 25. At the opposite end of the rocking bent lever 24 is mounted a roller 21 which bears against the circumference of pawl disk 8. The clamping lever 25 is mounted on the shaft 27 near the rocking bent lever 24. A spring 29 is mounted on the pull rod 28. One end of the spring 29 bears against a pair of regulation nuts 36 fitted at the end of pull rod 28 and with its opposite end against the arm of clamping lever 25.

A clamping brake 20 and regulation lever 22 are mounted on the shaft 40 of gear 33 shaft 40 being mounted with clearance on the side wall 31 of the printing machine. The gear 33 meshes with the teeth of intermediate gear 23 which mesh with the teeth of adjustable cam 4.

The arm of clamping lever 25 bears with its set-over part against the arm of reversed rocking bent lever 24 (FIG. 3).

The device operates as follows.

The sprocket 9 is driven from the form cylinder (not shown) by means of a chain. The sprocket 9 rotates in the direction of rotation of the doctor roller 1 and carries with its sprocket hub 11, pawl disk 8 and pawl 6. Pawl 6 is forced into contact with cam 5 and adjustable cam 4 by means of torsion spring 10. On adjustable cam 4 and cam 5 are formed two circumferential radii one of which is smaller than the other. When pawl 6 contacts the larger circumferential radii of adjustable cam 4 or cam 5, the pawl does not engage the teeth of ratchet wheel 7, and doctor roller 1 does not rotate. When pawl 6 contacts the circumferential radii of adjustable cam 4 or cam 5, the pawl engages the teeth of ratchet wheel 7, causing doctor roller 1 to rotate. The ink feed roller 18 continually rocks between contact with doctor roller 1 and distributing roller 19 due to the different radii of disk 8.

Upon loosening lock screw 41 and rotating regulation lever 22 which rotates gear 33, the adjustable cam 4 is rotated by means of gear 33 and the intermediate gear 23. Rotation of cam 4 changes the relation between the small and large radii of cam 4 and cam 5 and causes contact of pawl 6 with the different circumferential relationship of cam 4 and cam 5. The pawl 6 engages the teeth of ratchet wheel 7 which rotates doctor roller 1. Adjustable cam 4 and cam 5 have circumferential curves of corresponding shape. In the case when adjustable cam 4 is rotated toward cam 5 so that their circumferences coincide, the pawl 6 rolls intermittently on the large and small circumferential radii of cam 4 and cam 5 so that the maximum rotation of doctor roller 1 takes place, which is equal to a half rotation of the sprocket 9.

Manual control of the rate of rotation of doctor roller 1 can be carried out by means of knob 17. The rate of rotation of doctor roller 1 is adjusted by means of regulation lever 22 which causes rotation of adjustable cam 4 by means of gear 33 through intermediate gear 23. When the carrying pins 12 are engaged with recesses 3 in sprocket hub 11 of sprocket 9 (by pressing and holding the knob 17 toward the doctor roller 1), the doctor roller 1 ceases to rotate at the rate which was set by means of the regulation lever 22 and the doctor roller rotates continuously and the ink feed roller 18 is able to feed the maximum ink quantity to the distributing roller 19. When the carrying pins 12 are disengaged from the recesses 3 of sprocket hub 11 of sprocket 9 (by releasing the knob 17), the adjusted regimen of the rotation of doctor roller 1 which was adjusted by means of the regulation lever 22 is automatically renewed. The position of the regulation lever 22 is locked by means of the clamping brake 20 and lock screw 41.

1 - doctor roller
2 - insert
3 - recess
4 - adjustable cam
5 - cam
6 - pawl
7 - ratchet wheel
8 - pawl disk
9 - sprocket
10 - torsion spring
11 - sprocket hub
12 - carrying pin
13 - pin
14 - guide roller
15 - knob hub
16 - spring
17 - knob
18 - ink feed roller
19 - distributing roller
20 - brake
21 - pulley
22 - regulation lever
23 - intermediate gear
24 - rocking bent lever
25 - clamping lever
27 - arm
27 - shaft
28 - pull rod
29 - spring
30 - washer
31 - side wall
32 - slot
33 - gear
40 - shaft
41 - lock screw

What is claimed is:

1. Apparatus for transferring ink from a doctor roller to an ink distributing roller in a printing machine, comprising:

a first rotatable shaft for rotating said doctor roller;

stationary cam means surrounding said first shaft and including a rotationally adjustable cam;

a ratchet wheel secured to and coaxial with said first shaft adjacent said stationary cam means;

a first hub rotatably mounted on and coaxial with said first shaft;

a pawl disk coaxial with said first shaft and secured to said first hub for rotation therewith, said pawl disk having a relatively large radius circumferential portion and a relatively small radius circumferential portion;

a second shaft parallel to said first shaft;

a rocking bent lever mounted on said second shaft and having a follower roller engaging the circumferential portions of said pawl disk, to cause said lever to oscillate when said first hub is continuously rotated;

an ink feed roller coupled to said rocking bent lever for oscillatory movement between contact with said doctor roller and contact with said ink distributing roller in response to the oscillation of said rocking bent lever;

a pawl for intermittently rotating said doctor roller, said pawl being secured to a peripheral part of said pawl disk via a pin for continuous rotation about the axis of said first shaft when said first hub is continuously rotated, said pawl being rotatable about the axis of said pin and having (i) a cam folower portion riding on said cam means to cause said pawl to rotationally oscillate about said pin axis, and (ii) a ratchet wheel engaging part for intermittently engaging the teeth of said ratchet wheel to rotate said ratchet wheel, first shaft and doctor roller as said pawl oscillates rotationally in accordance with the overall contour of said cam means, to intermittently rotate said doctor roller when said first hub is continuously rotated;

a second hub coaxial with and rotationally coupled to said first shaft for selectively engaging said first hub to couple said first hub to said first shaft, to cause said first shaft and said doctor roller to continuously rotate when said first hub is continuously rotated;

a first spring for biasing said second hub out of engagement with said first hub; and manually operable means for moving said second hub into engagement with said first hub.

2. The device of claim 1 wherein a clamping lever having a set over part is mounted on the second shaft beside the rocking bent lever, said clamping lever having a cut-out through which passes a pull rod fixed at one end to the rocking bent lever, the rocking bent lever having an arm, the set over part of the clamping lever bearing against the arm of the rocking bent lever.

3. The device of claim 2 wherein a second spring is mounted on said pull rod, the clamping lever having an arm, one end of said second spring bearing against the arm of the clamping lever at the set over part thereof, and the other end of said second spring bearing against a regulation nut near the end of the pull rod opposite said one end thereof.

4. The device of claim 3 wherein the first shaft is fitted with guide rollers which ride in axially oriented slots formed in the second hub, and wherein said second hub has a cavity which fits over the end of the first shaft, a third spring being mounted in said second hub cavity, one end of said third spring bearing against an adjacent end of the first roller shaft and the other end of said third spring bearing against a spring bearing structure formed in the cavity in the second hub.

5. Apparatus for transferring ink from a doctor roller to an ink distributing roller in a printing machine, comprising:

a first rotatable shaft for rotating said doctor roller;

a first hub rotatably mounted on and coaxial with said first shaft;

means for continuously rotating said first hub;

a pawl disk coaxial with said first shaft and secured to said first hub for rotation therewith, said pawl disk having a relatively large radius circumferential portion and a relatively small radius circumferential portion;

means coupled to said pawl disk and said first shaft to intermittently rotate said doctor roller;

a second shaft;

a rocking bent lever mounted on said second shaft and having a follower roller engaging the circumferential portions of said pawl disk, to cause said lever to oscillate;

an ink feed roller coupled to said rocking bent lever for oscillatory movement between contact with said doctor roller and contact with said ink distributing roller in response to the oscillation of said rocking bent lever;

a second hub coaxial with and rotationally coupled to said first shaft for selectively engaging said first hub to couple said first hub to said first shaft, to cause said first shaft and said doctor roller to continuously rotate when said hubs are engaged; and manually operable means for selectively engaging said second hub with said first hub.

6. The device of claim 5 wherein a clamping lever having a set over part is mounted on the second shaft beside the rocking bent lever, said clamping lever having a cut-out through which passes a pull rod fixed at one end to the rocking bent lever, the rocking bent lever having an arm, the set over part of the clamping lever bearing against the arm of the rocking bent lever.

* * * * *